US005803948A

United States Patent [19]

Sizov et al.

[11] Patent Number: 5,803,948

[45] Date of Patent: Sep. 8, 1998

[54] PROCESS AND DEVICE FOR INTRODUCING GASES INTO METAL MELTS

[75] Inventors: Anatoly Sizov, St. Petersburg, Russian Federation; Horst-Dieter Schöler; Ulrich Meyer, both of Duisburg, Germany

[73] Assignee: Mannesmann Aktiengesellschaft, Düsseldorf, Germany

[21] Appl. No.: 628,682

[22] PCT Filed: Sep. 28, 1994

[86] PCT No.: PCT/DE94/01180

§ 371 Date: Jul. 1, 1996

§ 102(e) Date: Jul. 1, 1996

[87] PCT Pub. No.: WO95/10634

PCT Pub. Date: Apr. 20, 1995

[30] Foreign Application Priority Data

Oct. 15, 1993 [DE] Germany ..... 43 35 643.5

[51] Int. Cl.[6] ..... C21C 7/00

[52] U.S. Cl. ..... 75/556; 266/217; 266/265

[58] Field of Search ..... 75/443, 556, 557; 266/44, 217, 216, 265

[56] References Cited

U.S. PATENT DOCUMENTS

| | | | |
|---|---|---|---|
| 4,392,636 | 7/1983 | Clumpner | 266/265 |
| 4,438,907 | 3/1984 | Kimura et al. | 266/217 |
| 5,312,092 | 5/1994 | Decker et al. | 266/265 |

*Primary Examiner*—Scott Kastler
*Attorney, Agent, or Firm*—Cohen, Pontani, Lieberman & Pavane

[57] ABSTRACT

A process and a device for introducing gases into a metal melt contained in metallurgical vessels via ducts arranged in the refractory lining of the vessel. In order to permit deeper penetration of the jet of gas and better mixing with the melt, an oscillating jet of gas is produced and introduced into the melt. For this purpose, several acoustic generators with which the gas is brought into contact with the melt are provided in the device.

13 Claims, 3 Drawing Sheets

PROCESS AND DEVICE FOR INTRODUCING GASES INTO METAL MELTS

BACKGROUND OF THE INVENTION

1. Field of Invention

The present invention relates to a process for introducing gases into a metal melt contained in metallurgical vessels via ducts arranged in the refractory lining of the vessel, and a device for carrying out this purpose.

2. Description of Prior Art

Such a process and device are generally known from "Patent Abstracts of Japan" (Vol. 15, No. 76, C-809, Feb. 21, 1991) by JA-A 02 301 525.

In general, various gas flushing systems are known in steel mills for introducing gases into metallurgical melts which serve primarily for homogenizing and cleaning the melts. In general, the gas used is argon or nitrogen. Another field of use is the bottom-blown process with oxygen in metal treatment vessels such as furnace ladles, desulfurizing pans, etc. In this connection the gases are blown into the metal bath through the bottom of the vessel and the lining of the vessel walls.

The gas is ordinarily conducted through gas flushing stones, whether permeable or dense. In the case of the permeable flushing stones, the gas flows directly through the stone structure which has a capillaries system on the order of magnitude of 10 to 20.

The capillary or duct system of gas flushing stones has great resistance to flow. Upon the discharge of gas from the known gas flushing stones, particularly with a high rate of gas flow, bubbles of large size are formed as a result of the mixing together of small bubbles.

Furthermore, the existing embodiments of permeable gas flushing stones show low intensity upon the mixing of the metal melt and a low factor of utilization of the energy of flow.

Upon the use of slit ducts, longitudinal eddy structures arise during the flow of the gases through the ducts, with the result that the jet of gas is impeded and does not have sufficient intensity upon the mixing of the metal melt. This has the result, even when several ducts are used alongside each other, that the jets separate into a number of thin unstable jets, which in turn reduces the mixing of the melt.

SUMMARY OF THE INVENTION

The object of the present invention is to avoid the above-mentioned disadvantages and to provide a process and an apparatus corresponding to it in which, with only slight losses of energy, a deeper penetration of the jet of gas into the liquid melt and better mixing with the liquid melt are made possible, and in which the time for the homogenizing and cleaning of the melt is reduced.

In the process proposed, the gas, before being introduced into the metal melt, is fed into a gas distributor in which acoustic generators for the exciting of oscillations of the gas are provided. Depending on the properties of the flushing gas in the gas line and the development of the acoustic generators, the behavior of the gas oscillations and their frequency can be varied in regions. Upon the exciting of the gas by the acoustic generators, shock waves are produced which propagate themselves through the gas distributor and enter the ducts.

The oscillations of the gas jet, the interaction of the flows, and the formation of the shock waves within the acoustic generator are controlled, as a function of the properties of the flushing process and the environment into which the gas enters, in a frequency and amplitude which can be predetermined.

The excited gas is fed to the melt by ducts which are combined in a bundle. The thin jets flowing out of the bundle of ducts attract each other behind the mouth of the nozzle and thus stabilize the discharging total gas jet. This stable gas system produces an eddy system of high intensity in the metal melt and exerts a high positive influence on the mixing process of the metal melt in the metallurgical vessel. The eddy system here protects the metal melt not only kinetically but also with respect to the oscillation. The interaction between the flow of gas and the metal melt has a jet-like character. An eddy system with longitudinal and transverse waves is produced in the metallurgical vessel.

The ducts of the gas flushing stone have a triangular cross-sectional surface through which the jet of gas passes to the melt, free of resonance, by destruction of the longitudinal eddy system since resonance of the oscillation of the jet of gas by reflection on the duct wall does not take place, and thus without hindrance, to the melt.

The jets discharging from the nozzle of the triangular ducts with ultrasonic oscillations have a high suction capability. The melt is drawn in between the jets and comminuted or broken up in the ultrasonic field in the system of the coherent transverse eddy. A two-phase flow is formed inter alia by reduction of the partial pressure of the released gases from the melt. The center of the jet spreads out in this two-phase flow, which permits a high range of action of the jet. The negative influence of otherwise customary small and large bubbles and the bubble oscillation which occurs in this connection is eliminated. In an advantageous embodiment, while retaining all advantages of the process shown, a form of the device is indicated which prevents a discharge of metal melt from the metallurgical vessel via the gas distributor. For this purpose, metallic structural parts are provided which, upon a decline in the pressure of the flushing gas, cool the entering metal melt to such an extent that it freezes.

One embodiment of the invention is shown in the accompanying drawings.

DETAILED DESCRIPTION OF THE PREFERRED EMBODIMENTS

Figure 1:
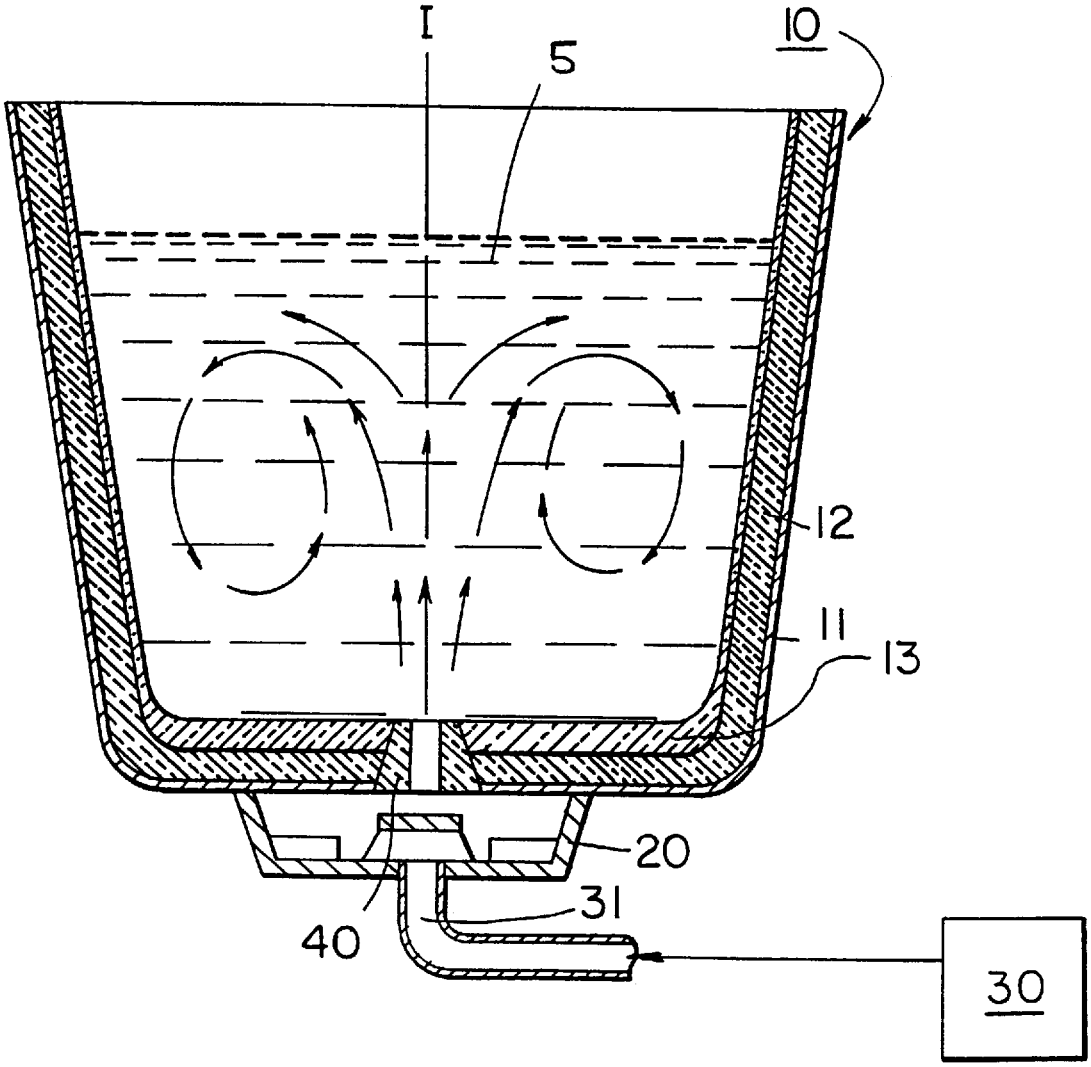
FIG. 1 is a section through a metallurgical vessel.

FIG. 1 shows a metallurgical vessel 10 having the metal shell 11 and a refractory lining 12. In a bottom 13 of the vessel 10, a refractory part 40 is provided as a gas flushing stone. Below the bottom 13 there is arranged a gas distributor 20 which is connected by a gas feed line 31 to a gas supply station 30. The melt S is contained within the vessel 10. The direction of flow of the melt around the central axis I is indicated by the arrows.

Figure 2:
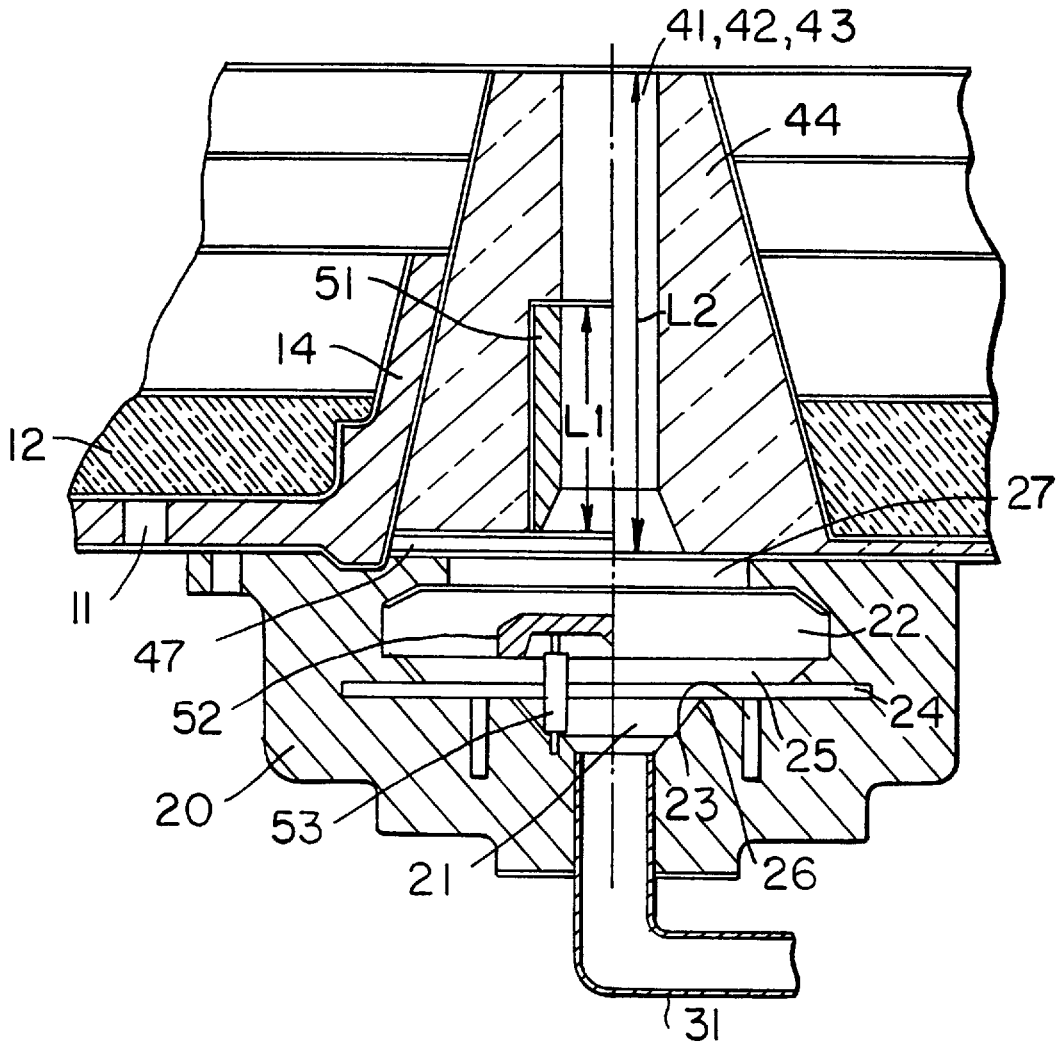
FIG. 2 is a section through a gas distributor and a gas flushing stone.

FIG. 2 is a detailed view of the refractory part 40 as well as of the gas distributor 20 which is connected by the feed line 31 to the gas supply station 30.

The gas distributor 20 has an antechamber 21 and a main chamber 22. In the region of the mouth 26 of the antechamber 21 there is an annular groove 23 which is coaxial to the main axis I. A disk-shaped groove 24 is provided perpendicular to the annular groove 23. Both grooves are developed as acoustic generators and place the gas in oscillations within the ultrasonic range. Preferably, the pulsation frequency of the gas is set at 20 to 500 Hz when the pressure is 2 to 10 bar.

Between the antechamber 21 and the main chamber 22 there is a support ring 25 on the inner wall of the gas distributor 20. This support ring is developed in such a manner that both the acoustic generator developed as an annular groove 23 and the acoustic generator developed as a disk-shaped groove 24 can have a combined influence on the gas.

As shown in the left-hand part of with FIG. 2, in the main chamber 22, there is provided a plate 52 which rests on support elements 53. This plate 52 is of circular shape and is made of metal which, upon melt possibly entering opposite the direction of flow of the gas, freezes and prevents emergence of the melt from the vessel or the gas distributor 20. The housing of the gas distributor 20 is fastened to the shell 11 of the metallurgical vessel 10.

The refractory part 40, in an embodiment such as shown in the left-hand side of the drawing, is arranged in a housing 14 in the refractory lining 12. A ceramic support member 44 has ducts 41, 42, 43 arranged therein.

On the left-hand side of the FIG. 2, a part of the duct 41 is shown in the form of a metal tube 51 and the length L1 of the tube is about half as great as the length L2 of the support member 44.

Between the outlet 27 of the main chamber 22 and the support member 44, there is a packing 47.

Figure 3A:
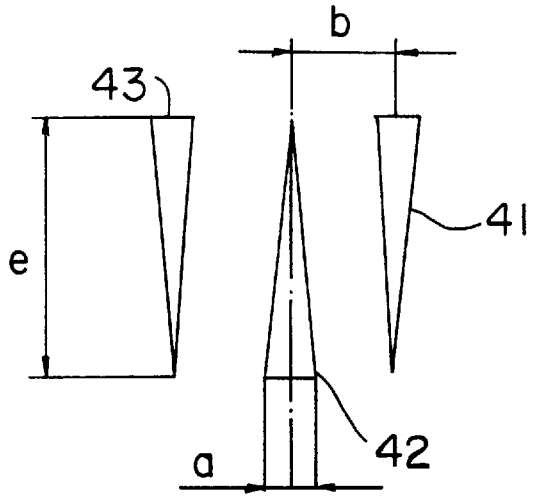
FIGS. 3*a* and 3*b* are a top view of the ducts.
Figure 3B:
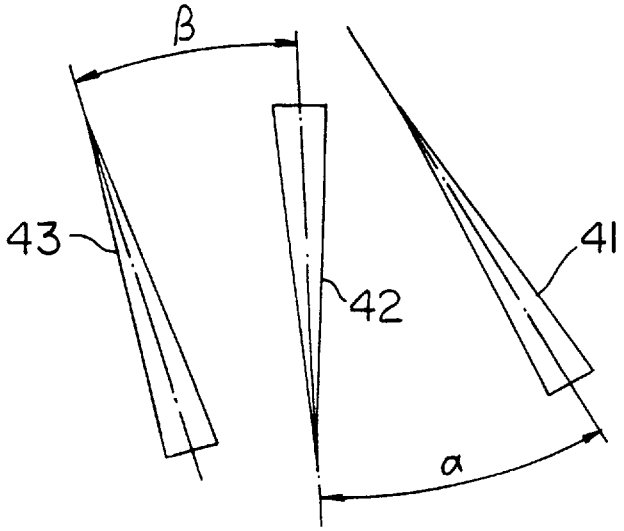

FIGS. 3*a* and 3*b* are a top view of the ducts 41 to 43. These ducts have a cross-sectional surface in the form of an isosceles triangle.

In the FIG. 3*a*, the individual ducts 41, 42, 43 are arranged parallel to each other. In this connection, the letter a designates the width of the duct, the letter b the distance between the center lines of two ducts when the ducts are arranged parallel to each other, and the letter e the length of a triangular duct. The ratio of the distance between the duct axes b and the duct width a is b:a=1.05:2.05. The ratio of duct nozzle lenght 1 to the width a is 1:a=13.1:14.5.

In FIG. 3*b*, the individual ducts are adjustably inclined with respect to each other by an angle of inclination $\alpha$ and $\beta$, respectively which angle lies between 0° and 90°.

We claim:

1. A process for introducing gas into a metal melt present in a metallurgical vessel via ducts arranged in a refractory lining of the vessel, the process comprising the steps of:

introducing gas into a gas distribution antechamber;

subsequently passing the gas around a first acoustic generator to create an oscillating jet of gas;

feeding the oscillating jet of gas to at least one second acoustic generator and exciting the jet of gas to periodic oscillations;

conducting the oscillating, excited gas jet into a gas-distribution main chamber; and feeding the gas jet from the main chamber via the ducts to the melt contained in the vessel.

2. A process according to claim 1, when the step of feeding the excited jet of gas to the melt includes feeding the jet as a bundle of jets via a group of at least three ducts.

3. A process according to claim 2, wherein the step of feeding the excited jet of gas via the ducts includes feeding the gas jet without resonance.

4. A process according to claim 1, including setting the periodic oscillations to a pulse frequency of 20 to 500 Hz when a pressure of 2 to 10 bar is present.

5. A device for introducing gases into a metal melt contained in a metallurgical vessel having a bottom, comprising:

a gas distributor having a main chamber and, on a gas entrance side, an antechamber;

a first acoustic generator configured as an annular groove coaxial to a central axis of the gas distributor, the annular groove being in a region of a mouth of the antechamber;

a second acoustic generator configured as a disk-shaped groove arranged in the gas distributor so as to adjoin a mouth of the annular groove and extend radially outward;

a support ring arranged behind the disk-shaped groove, in a gas flow direction, so as to extend into the gas distributor and separate the antechamber from the main chamber; and at least three paraxial slit-shaped ducts arranged at an outlet of the main chamber so as to discharge into the bottom of the vessel.

6. A device according to claim 5, wherein the slit-shaped ducts have a cross-sectional surface configured as an isosceles triangle.

7. A device according to claim 6, wherein each duct has a width a and a longitudinal axis b, the ducts being configured so that when arranged parallel to one another, a ratio of distance between the duct axis b to the duct width a is b:a=1.05:2.05, each duct having a duct nozzle with a length 1 which is in a ratio to the width a of 1:a=13.1:14.5.

8. A device according to claim 7, wherein the triangular ducts are inclined at an angle to each other, the angle of inclination being within a range of 0° to 90°.

9. A device according to claim 5, wherein each of the slit-shaped ducts has a part that faces the main chamber, the part being a metal tube.

10. A device according to claim 5, and further comprising a metal plate arranged in the main chamber in a plane perpendicular to the central axis.

11. A device according to claim 10, wherein the metal plate has a circular shape, and further comprising elements that connect the metal plate to a wall of the antechamber.

12. A device according to claim 5, and further comprising gas feed means for feeding gas to the mouth of the antechamber of the gas distributor.

13. A device according to claim 5, and further comprising a ceramic support member mounted to the gas distributor at the outlet of the main chamber, the slit-shaped ducts being arranged within the ceramic support member.

* * * * *